United States Patent [19]

York

[11] 4,403,635

[45] Sep. 13, 1983

[54] POWERED WOOD SPLITTER WITH MULTIPLE WORK HEADS

[76] Inventor: Floyd L. York, 33575 Bonnie B Rd., North Fork, Calif. 93643

[21] Appl. No.: 151,306

[22] Filed: May 19, 1980

[51] Int. Cl.[3] ..... B27L 7/00

[52] U.S. Cl. ..... 144/366; 74/63; 144/194; 408/714

[58] Field of Search ..... 144/193 R, 193 D, 194, 144/366; 74/63; 408/714

[56] References Cited

U.S. PATENT DOCUMENTS

| | | | |
|---|---|---|---|
| 4,014,622 | 3/1977 | Lotz | 408/714 |
| 4,188,987 | 2/1980 | James | 144/194 |
| 4,252,166 | 2/1981 | Kozicki | 144/194 |
| 4,338,052 | 7/1982 | Lockett | 408/714 |

FOREIGN PATENT DOCUMENTS

| | | | |
|---|---|---|---|
| 2814249 | 7/1979 | Fed. Rep. of Germany | 144/194 |
| 2073656 | 10/1981 | United Kingdom | 144/194 |

*Primary Examiner*—W. D. Bray

[57] ABSTRACT

This is a powered device primarily used for the splitting of wood, but also can be used as a boring tool, and as a device for performing any number of functions wherein tools can be placed on a plurality of output heads to perform a variety of accomplishments. This device can accept power from a variety of sources such as gasoline and electrically powered chain saws, flexible cable drives, and from any number of portable power sources such as drive wheels of automobiles, pneumatic motors and hydraulic motors. This mechanism is also characterized by being able to have the multiple output heads rotate in opposite or similar directions.

10 Claims, 17 Drawing Figures

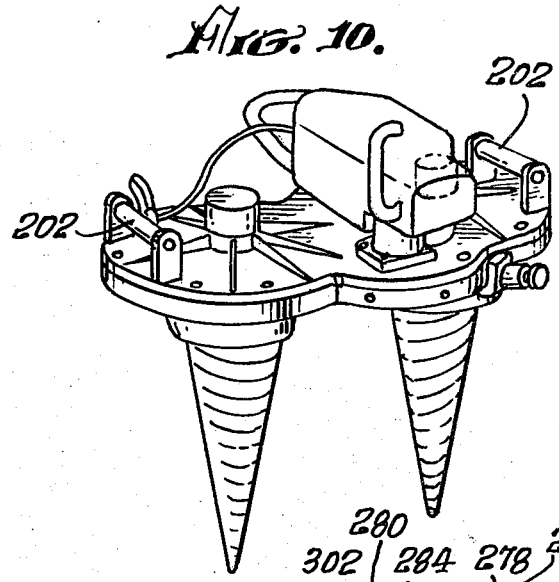
Fig. 10.
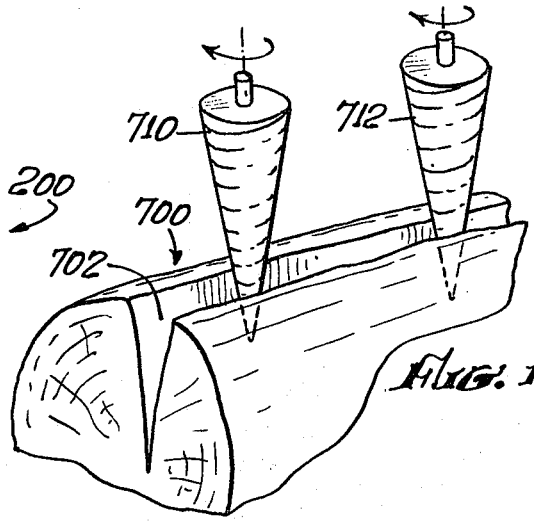
Fig. 13.
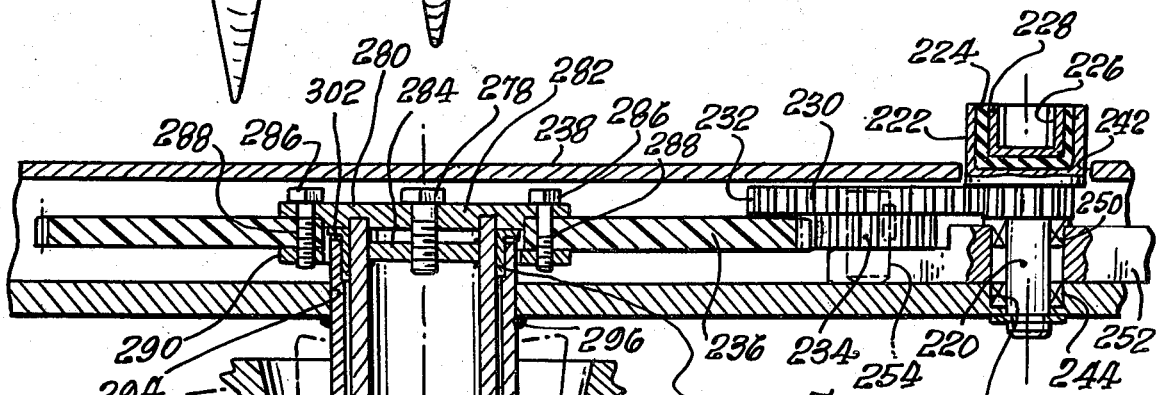
Fig. 11.
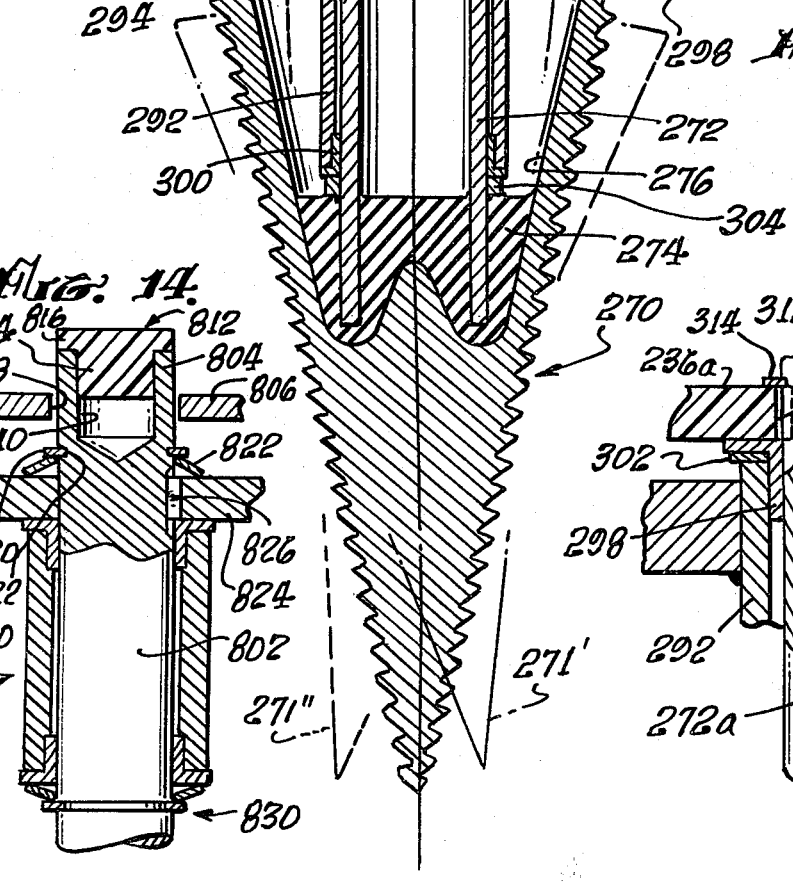
Fig. 14.
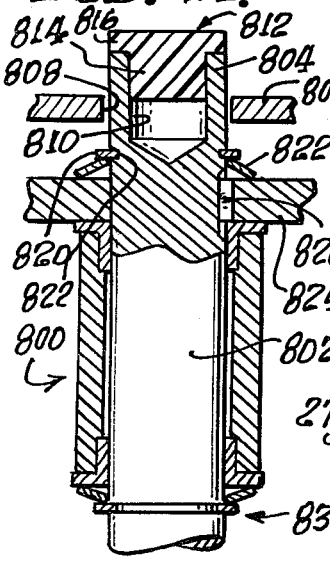
Fig. 12.
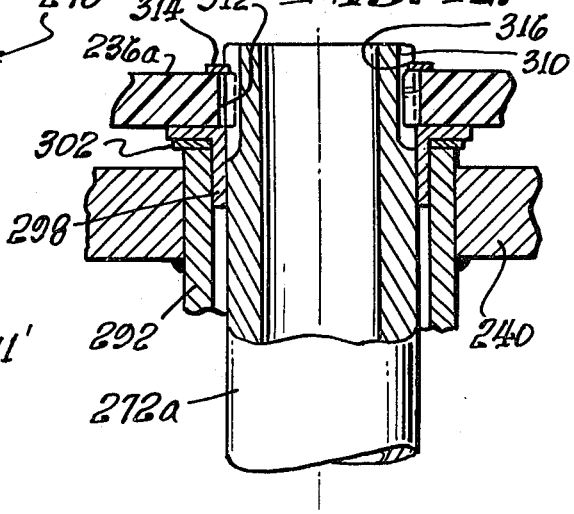

POWERED WOOD SPLITTER WITH MULTIPLE WORK HEADS

CROSS REFERENCE TO RELATED PATENT APPLICATIONS

This application is not related to any other patent application filed by me.

BACKGROUND OF THE INVENTION

1. Field of the Invention

This invention is in the general field of wood splitting or hole boring devices, and is more particularly directed to a device for splitting both logs and rounds of cut timber into smaller parts and to do this in a manner which will allow the operator of this device to perform the splitting operation without any undue effort to compensate for the torque which is generally created by the use of a single output head. I have also directed the construction of this device to perform a number of variations in the output rotation speed as compared to the input rotation, and have provided a portable unit which can be taken to remote areas away from a general stationary power source and I have provided a simplified form for attaching and detaching input and output equipment.

2. Description of the Prior Art

Wood splitting devices have been known for great periods of time, and there have been many different models in the past. The number of such devices is far to great to list in the prior art, but, it is sufficient to point out that there are no known wood splitting devices utilizing the principal of having a plurality of output heads performing the splitting operation thereby neutralizing any torque that might be created. An example of an attempt to have made wood splitting easier is a cone-shaped tip which is fastened to a single output shaft and then pressed against a log. This cone-shaped member is provided with a screw type thread on the outer surface and when this is pressed against a log, it moves into the log as a screw driven by a screwdriver, but while this is taking place, the operator must go to great lengths to hold the log in this operation.

Additionally, none of these devices have utilized a plurality of cone-shaped screws rotating in similar or opposite directions in order to compensate for the previously described torque.

Furthermore, none of these devices have attempted to control the speed of a plurality of said wedge cones to make the splitting operation successful. In the sense of these unique features there is not prior art comparable to the present combination.

SUMMARY OF THE INVENTION

Wood splitting devices have been used for many years in the past and prior to the advent of gasoline engines and electrical motors, were primarily accomplished by driving wedges of a flat triangular shape and more recently in the form of a cone-shaped wedge.

With shortages occurring, however, in petroleum products and the like, new efforts have been directed toward the use of wood as a supplementary fuel. This has led to many improvements in the art of wood splitting.

One of the important features of the current improvements has been the conical-shaped wedge which has had a spiral thread formed on the outside similar to the woodscrew, and this wedge has been mounted onto rotating output shafts of a number of power devices.

There have been other developments somewhat akin to this conical wedge and all of these are worthy.

In all of the uses of these newly developed conical wedges, however, there are still some shortcomings, one of which is the inability to meet the problem of the tremendous torque created by the action of the wedge.

In all of the wood splitters so developed recently, there is also no positive way of accomplishing the fracturing of the wood along a common flow of grain when such grain is interrupted and intertwined about a knot.

Additionally, it is found that many of the power operated wood splitting units are difficult to transport and to set up at the site of the splitting operation.

After a considerable period of study and development, I have now conceived and actually developed a wood splitter for performing a safe and accurate wood splitting operation which does not require opposition to the torque created, and at the same time, accomplishes in a rapid fashion, the splitting operation.

Additionally, I have provided a wood splitter which is light weight in construction and is easily moved to the site of the tree itself.

Further, I have studied the problem of adapting such a device to any common power source, such as chain saws, boring devices, and power outputs such as automobile wheel output shafts.

As a last refinement, I have provided a device which can be easily converted into a multiple output head mechanism which can adapt to a number of work accomplishments.

The foregoing and other objects and advantages of this invention will become apparent to those skilled in the art upon reading the foregoing description of a preferred embodiment in conjunction with a review of the appended drawings.

BRIEF DESCRIPTION OF THE DRAWINGS

FIG. 10 is a perspective view of a modified form of wood splitting mechanism;

FIG. 11 is an enlarged fragmentary cross sectional view of another embodiment of my invention;

FIG. 12 is an enlarged fragmentary sectional view of another means of attachment of the cone assembly;

FIG. 13 is a schematic perspective view showing the conical wedges rotating in the same direction as opposed to rotating in different directions;

FIG. 14 is an enlarged cross sectional view similar to FIG. 11 showing an alternate embodiment of the shaft construction of my device;

DESCRIPTION OF A PREFERRED EMBODIMENT

Figure 1:
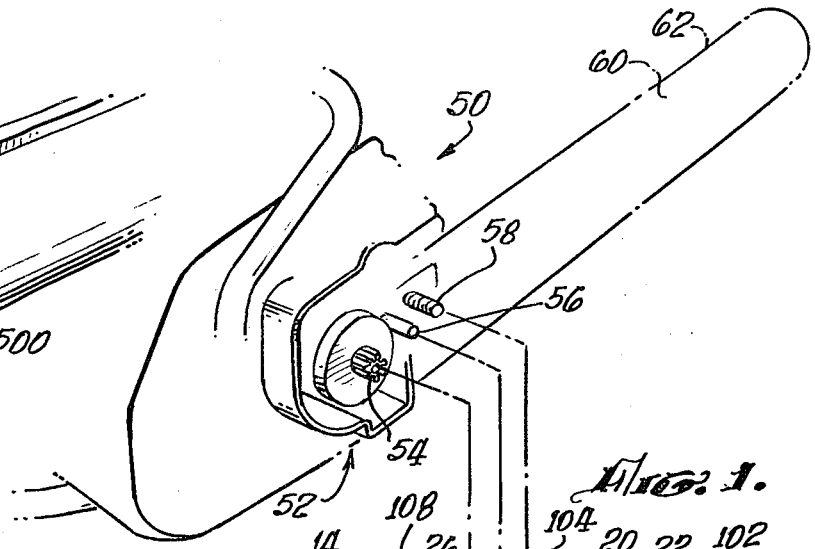
FIG. 1 is a perspective view of my invention showing a method of attaching to the output power of a chain saw and oriented in a manner wherein it is about to be placed onto a round of wood cut from a log.

I have shown in FIG. 1 a perspective view of the wood splitter of my invention, indicated by the reference numeral 10, poised over a round of a tree which is to be split into segments, and a conventional chain saw power unit 50 with the power output assembly 52 exposed and ready for adaptation to the unit 10. To those familiar in the art the power unit 50 has an output pinion 54 and a pair of mounting bolts 56 and 58 which normally support a guide bar 60 as indicated in phantom lines in FIG. 1. A conventional woodcutting chain 62 would normally be mounted about the guide bar 60.

The wood splitting unit 10 is constructed with a housing 12 having a cover plate 14 and a bracket assembly 16 which supports a mounting projection 18 having an alignment opening 20 along with a threaded nut arrangement 22, similar to a camera attachment means, in order to secure the chain saw drive assembly 52 to the wood splitting assembly. The housing 16 also provides a means for supporting an input shaft 24 having a sprocket receiving opening 26 in order to mate with the drive sprocket 54. The shaft 24 is attached to a drive pinion 28 mounted in bearing 30 and having a key connection to a reduced portion 32 of shaft 24.

Figure 6:
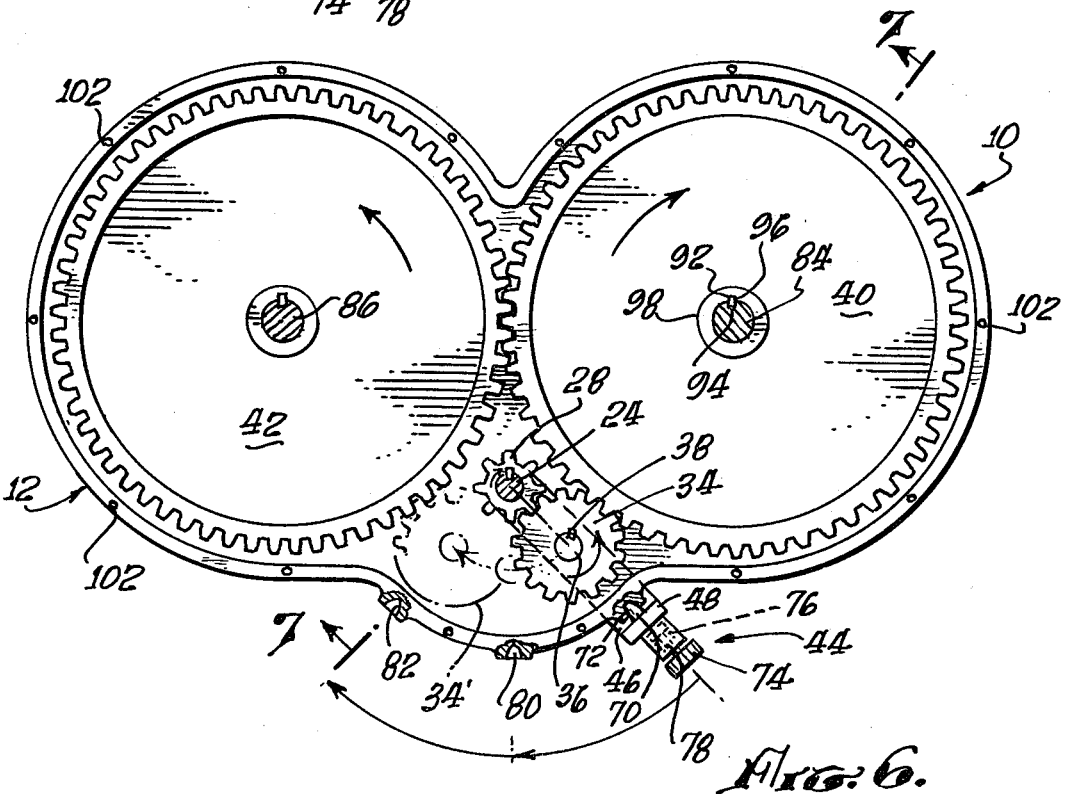
FIG. 6 is a view similar to FIG. 5 with the cover portions removed and with portions shown partly in section.
Figures 7, 8, 9, 15:
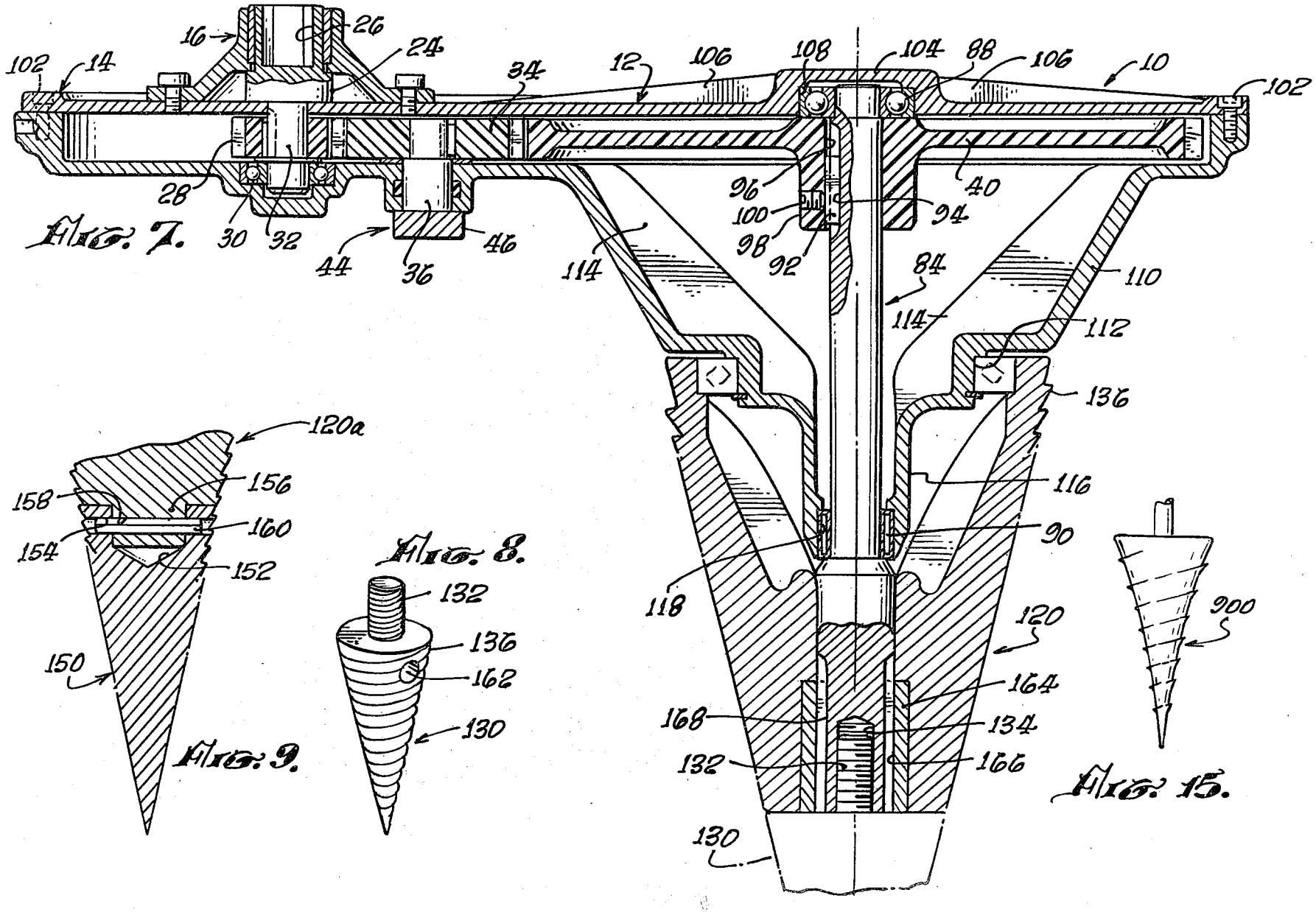
FIG. 7 is an enlarged sectional view taken on line 7—7 of FIG. 6.
FIG. 8 is a perspective view of a special tip which can be added to the conical wedge shown in FIG. 7.
FIG. 9 is a fragmentary sectional view showing an alternate method of attaching a pointed tip to the wedge described in FIG. 7.
FIG. 15 is a side elevational view of a tip attachment showing a design of another configuration.

It can be readily seen in FIG. 6 and the cross sectional view of FIG. 7 that the drive pinion 28 is meshed with an intermediate drive gear 34 mounted on shaft 36 by means of a key arrangement 38 and this gear, in turn, may be moved arcuately from meshing with a larger gear 40 to a position indicated by phantom lines 34' in FIG. 6 to mesh with a second gear 42. In so doing, drive can be administered either to gear 40 or gear 42 in order to reverse direction of these gears.

An indexing unit 44, comprising an arm 46 pivotally mounted to shaft 36 and having an upwardly extended portion 48 which supports an index pin 70, is provided. This pin can be withdrawn from a recess 72 in the wall of housing 12 and pulling out an enlarged knob portion 74 against the action, an enclosed spring 76 confined within a housing 78 which is mounted onto upwardly projecting portion 48.

The movement of the arm 46, then can be accomplished to a neutral position at the point of a second opening 80 or further movement to an opening 82, will place the gear 36 into its second drive position. The gears 40 and 42 are fixedly mounted to a pair of elongated shafts 84 and 86, respectively. These shafts are then mounted in a manner to be described hereinafter to the wood splitting cones. Each of the shafts 84 and 86 and their respective cone assemblies are similar to one another so description will be focused to one assembly only.

As can be readily seen in the enlarged cross sectional view of FIG. 7, shaft 84 is mounted in upper and lower bearing assemblies 88 and 90, and is affixed to gear 40 by means of a key 92 securely fastened into keyways 94 of shaft 84 and 96 of hub portion 98 of gear 40, by means of a set screw 100.

The coverplate 14 is fastened to the main housing 12 by means of a series of screws or bolts 102 and said cover having central hub portions 104 and having radiating reinforcing ribs 106 and a carrying handle 108. The hub portions 104 provide a reinforced flat area which can be tapped with a tool such as a hammer or mallet in order to start the conical splitting screws into a log or a round of wood as indicated in FIG. 1, to facilitate an easier start to the splitting operation. The boss portion 104 provide a cylindrical bore 108 for bearings 88.

I have provided enlarged downwardly projecting housing portions 110 having bearing race 112, reinforcing ribs 114 and a reduced extension 116 with a bearing bore 118 to accommodate bearing 90. The housing 12 and cover plate 14, as should be familiar to those in the art, may be constructed of a strong magnesium or aluminum alloy.

Supported onto this housing 110 is a frusto-conical externally threaded member 120. This member is retained in position by means of a pointed tip member 130, also externally threaded in the same manner as 120, and having a threaded stud 132 which can be screwed into a threaded opening 134 in the lower end of shaft 84. The frusto-conical member 120 can be fabricated from a magnesium composition, anodyzed and Teflon coated, while the tip portion 130 can be of heat treated steel and Niboron plated. The threads 136 on both members 120 and 130 can be of any cross section desired such as can conventionally be formed by those familiar in the art of machining, and can be approximately four threads to the inch.

In FIG. 9 it can be seen that an additional method of attachment can be provided wherein the tip portion 150 having a recess 152 and provided with a hole 154 can be placed onto a reduced diameter portion 156 projecting downwardly from a modified cone portion 120*a* having an opening 158. When openings 154 and 158 are in alignment with one another, a steel roll pin 160 can be inserted in order to complete attachment. In the tip portion of FIG. 8, a wrench opening 162 can be provided in order to effect the screwing on of tip 130 into opening 134.

Additionally, a steel insert 164 can be pressed into housing 120 and splined at 166 to match splines 168 on shaft 84 to ensure positive engagement of the relative parts in the enlarged section of FIG. 7.

FIG. 10 illustrates a modified form of the wood splitting unit and is indicated by the reference numeral 200. The pair of handles 202 replace the single handle 108 of the assembly of FIG. 1.

A further modification of the wood splitting mechanism is shown in FIG. 11. In this enlarged cross section the input shaft 220 having a drive pinion 222 fixedly mounted thereon and incorporating a rubber cup 224 mounted in a receiving opening 226. This rubber insert allows for a certain amount of misalignment between an input drive means such as a sprocket 54 or the like, when it is inserted into the sprocket receiving member 228 for dampening of vibration.

In the construction of FIG. 11, I have also provided for a further gear reduction by means of a two step pinion 230 having a larger pitch diameter gear 232 and a smaller pitch diameter gear 234. As can be seen in the drawing, power is transmitted from pinion 222 through gear 232 and then through 234 onto large diameter gear 236. This gear 236 is equivalent to gears 40 and 42 mentioned in a previous embodiment. Cover plate 238 fixedly mounted to housing 240 is provided with an opening 242 to allow the pinion assembly to project outwardly therefrom. Bearing 244 supporting shaft 220 is mounted in a recess 246 of the housing and a second bearing 250 mounted in a shifting arm 252 similar to the arm 46 provide retainment of the input shaft assembly into the present embodiment. The arm 252 is pivotally mounted onto shaft 254 of the gear 230.

The embodiment of FIG. 11 is shown to have a feature of mounting the frusto-conical threaded member 270 onto an elongated hollow shaft 272 by means of moulding it to the shaft in the following manner. A body of rubber 274 is bonded to the inside cavity 276 of the conical member 270 and also to inner and outer surfaces of the hollow sleeve 272. By means of a bolt 278 passing through a clamping plate 280 and threadedly engaging the sleeve 272 into a groove 282 by means of tightening up on a plate 284 welded to the inside of the hollow sleeve. The gripping plate 280 by means of bolts 286 passing through openings 288 in gear 236 and then threadedly attached to a clamping ring 290 fasten the cone supporting assembly to the gear 236. A downwardly projecting sleeve housing 292 passing through an opening 294 in the bottom wall of the housing 240 and welded thereto at 296 provides a stable support for sleeve 272. Sleeve bearings 298 and 300 bearing against washer 302 and ring 304, the latter of which is welded to sleeve 272, complete the rotational assembly between the sleeve 292 and sleeve 272.

Figure 4:
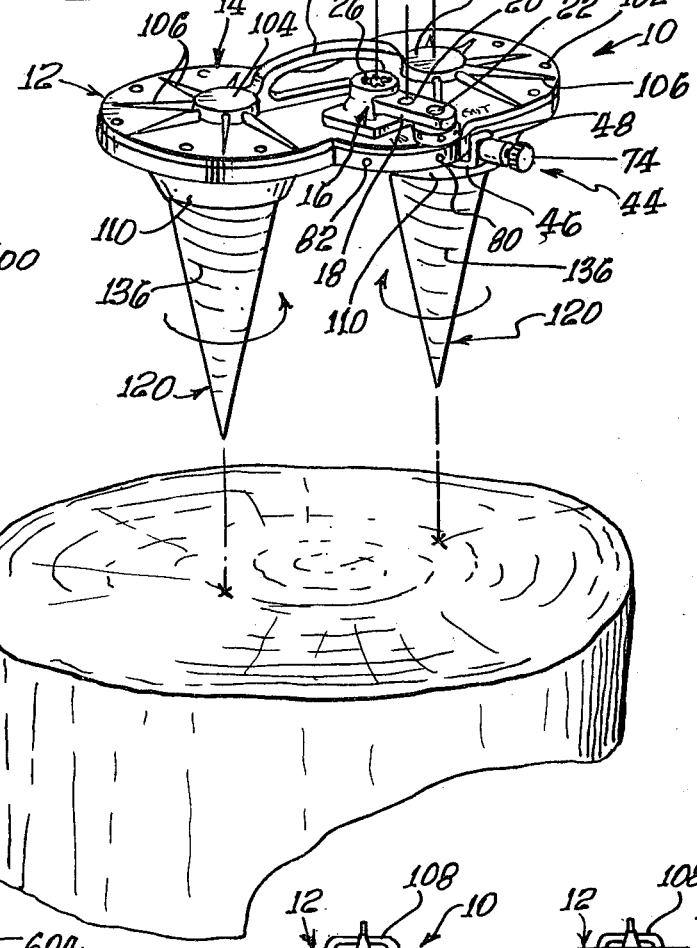
FIG. 4 is a view showing the manner in which the two rotating conical screw wedges would split along two different grain lines which are normally found about a knot.

When the conical splitting member 272 is augered into a log of wood, it can be seen that as the screw progresses into the grain that the member 270 can follow the grain should it begin to divert into a different plane. Referring to FIG. 4, the phantom line position 271' and the dotted line position 271" indicate this movement.

FIG. 12 illustrates an additional means of supporting a modified sleeve **272*a* to the gear 236*a*. This is accomplished by splining the upper end of sleeve 272*a* at 310 and providing an internally splined opening 312 in gear 236*a*. A split retaining ring 314 fitting into groove 316 of shaft 272*a* completes the assembly. In this figure, sleeve bearing 298, steel spacer washer 302, sleeve 292 and housing walls 240 are identical to those in FIG. 11**.

Figure 2:
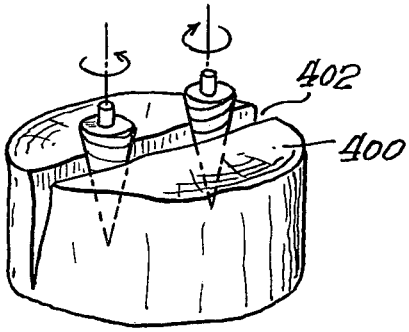
FIG. 2 is a schematic perspective showing the rotation direction of each of the cone wedges as utilized in my device.

FIGS. 2, 3, 4, and 13 are schematic illustrations showing the manner in which the multiple head splitting actions are accomplished. In FIG. 2 the splitting heads rotating in opposite directions are shown progressing down into a round of wood indicated by the reference numeral 400 and along a split 402 dividing it into smaller portions. It is understood that by reversing the rotation of these heads by the methods described earlier in this application, one can withdraw the conical heads should it be necessary because of a jamming of binding during the splitting operation.

Figure 3:
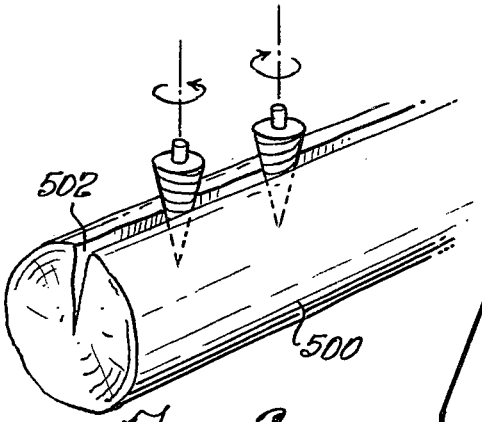
FIG. 3 is a schematic perspective indicating the rotating threaded cones being applied to a log along a longitudinal plane and performing the splitting operation.

In FIG. 3 I have shown a log 500 and the conical heads proceeding to form a split 502.

FIG. 4 presents a very special problem in log splitting where a log 600 having split line 602 being acted upon by a conical splitting head 610 and a second splitting line 604 being acted upon by head 612 in two different planes in order to bypass a knot 606. This is a unique feature of my invention which is accomplished especially by the form illustrated in FIG. 11, wherein the heads 610 and 612 can follow the plane of the grain in their respective grooves and self-align because of their rubber mounting.

In FIG. 13, I have shown a log 700 being split along a line 702 by a pair of conical splitting heads 710 and 712, but in this case the heads are rotating in the same direction. This rotation can easily be accomplished by those familiar in the art by means of a chain drive or gearing presented in such a manner so as to accomplish this direction.

I have shown in FIG. 14, an alternate embodiment of shaft construction, similar to that of FIG. 11, but with a provision for the shaft to pass through the housing cover. The reference numeral 800 designates generally the shaft assembly. The shaft 802 having an extending portion 804 passing through the cover 806 through an opening 808 is provided with an opening 810. This opening provides for a plug which can be inserted for a purpose which is to be described hereinafter. The plug 812 has a reduced diameter portion 814 and an enlarged flanged portion 816 and is constructed of a material which will take a high impact stroke from a hammer, or the like. The shaft 802 is provided with a groove 818 into which a snap ring 820 is fitted. A Belleveille-type spring washer 822 is then inserted between the snap ring 820 and the drive gear 824. The drive gear is fixedly mounted to shaft 802 at 826. A similar shock absorbing washer assembly 830 is provided at a second location along the shaft 802. Hitting the cap 812 for the purpose of starting the splitting operation can be absorbed along the shaft and its mounting within the housing without serious damage to the shaft assembly.

FIG. 15 shows a cone 900 which can be attached to the wood splitting apparatus. This cone is constructed in a parabolically-shaped curve configuration in order to better penetrate the wood being split.

Figure 16:
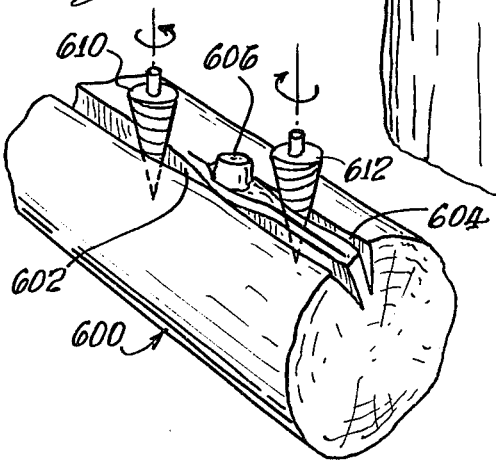
FIGS. 16 and 17 schematically show other uses for my tool.
Figure 16:
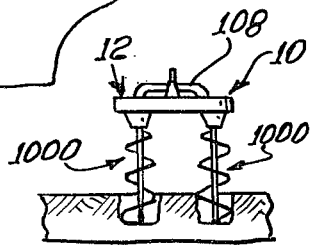

FIG. 16 is a view showing how my invention can be utilized for drilling holes. The boring tools 1000 can be constructed in a variety of designs to those familiar in the art of digging holes.

Figure 17:
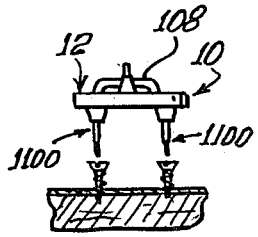
Figure 5:
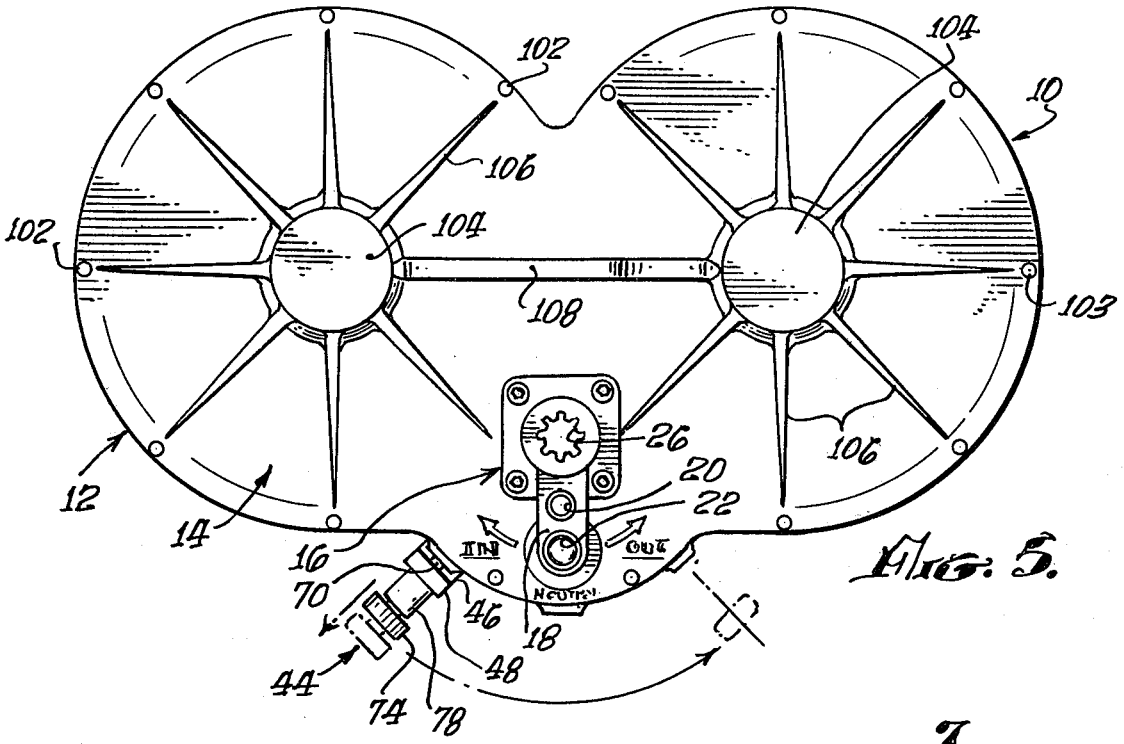
FIG. 5 is an enlarged top plan view of the device of FIG. 1.

FIG. 17 is a schematic showing of a multiple output tool similar in design to my wood splitting apparatus described earlier in this application. In this case, tools such as screw drivers 1100, can be inserted into proper collets and made to screw in both left-handed and right-handed screws, simultaneously.

While the embodiments of this invention, shown and described, are fully capable of achieving the objects and advantages desired, it is to be understood that these embodiments are for the purposes of illustration, and not for purposes of limitation.

I claim:

1. The method of splitting a piece of wood into a plurality of pieces with a portable powered hand-held device having at least two rotating output shafts which comprises: (1) attaching a conically-shaped, externally grooved member to each shaft in such manner that said conical members can be rotatably operable on an axes other than that of the rotating output shafts; (2) applying said conical members to said piece of wood in such manner that each conical member is in a different plane than the other in relationship to the various grains in the wood; and (3) moving said conical members into the piece of wood to spread the segments of wood from one another.

2. The method as described in claim 1 wherein the conical members are rotated in the same direction to one another.

3. The device as set forth in claim 1 wherein the conical members are rotated in opposite directions to one another.

4. A powered portable hand-held device of the type having at least two driven torque-compensating output shafts which shafts rotate in similar or opposite directions to each other, comprising: self-alignment means provided on each output shaft to allow tool attachments to be rotated on their respective shafts about their respective axes on longitudinal respective axes different to those of said output shafts.

5. An apparatus as set forth in claim 4 wherein said output shafts are provided with shock-absorbing means so that when said shafts are struck manually at their ends opposite said tool attached ends, said shafts are not damaged by such blow.

6. The device of claim 4 wherein the power transmitting means is provided with means for reversing the direction of rotation of said output shafts.

7. The device of claim 4 wherein the rotational output drive means are connected to conically-shaped externally spiralled groove means.

8. The device of claim 7 wherein the conically-shaped externally spiralled groove means are formed in a clockwise direction.

9. The device of claim 8 wherein said grooves are formed in a clockwise and counter-clockwise direction.

10. The device of claim 9 wherein an input drive means is provided having a self-aligning means.

* * * * *